United States Patent [19]

Voelker et al.

[11] 4,337,725

[45] Jul. 6, 1982

[54] APPARATUS FOR COATING WIRES WITH INSULATOR

[75] Inventors: Wolfgang Voelker, Arolsen; Alfons Schmitt, Neuhof; Fritz Radeck, Arolsen, all of Fed. Rep. of Germany

[73] Assignee: Felten & Guilleaume Carlswerk Aktiengesellschaft, Cologne, Fed. Rep. of Germany

[21] Appl. No.: 243,340

[22] Filed: Mar. 13, 1981

Related U.S. Application Data

[62] Division of Ser. No. 167,323, Jul. 10, 1980.

[30] Foreign Application Priority Data

Jul. 30, 1979 [DE] Fed. Rep. of Germany ..... 2930870

[51] Int. Cl.[3] ..... B05B 5/02; B05C 11/10

[52] U.S. Cl. ..... 118/665; 118/624

[58] Field of Search ..... 427/9, 10, 32; 118/624, 118/636, 665

[56] References Cited

U.S. PATENT DOCUMENTS 3,801,349 4/1974 Wilson et al. ..... 427/10

*Primary Examiner*—Evan K. Lawrence

*Attorney, Agent, or Firm*—Michael J. Striker

[57] ABSTRACT

A device for coating wire with a pulverized insulating material wherein wire is coated with the insulator in an electrostatic coating machine which establishes a potential difference between the wire and the insulation and thereby causes the insulation to adhere to the wire electrostatically, without the use of solvents. After such coating, the coated wire is sintered and hardened in a sintering and hardening oven in order to form a lacquered wire with a uniform insulation thickness. Insulation thickness can be maintained at a desired value by the control device for adjusting the length of wire being exposed to the insulator in pulverized form within the electrostatic coating machine. The supply of insulator used in pulverized form is continuously fed from a reservoir into the electrostatic coating machine so as to prevent smaller and lighter particles from being first attracted to the wire, and thereby depleting such particles excessively while leaving only larger and heavier particles available for coating. The final thickness of the insulation is constantly measured by a thickness sensor and kept within a predetermined tolerance by varying the rate of feed of insulator supply to the coating machine by a valve connected to the sensor, directly as a function of insulation thickness.

10 Claims, 1 Drawing Figure

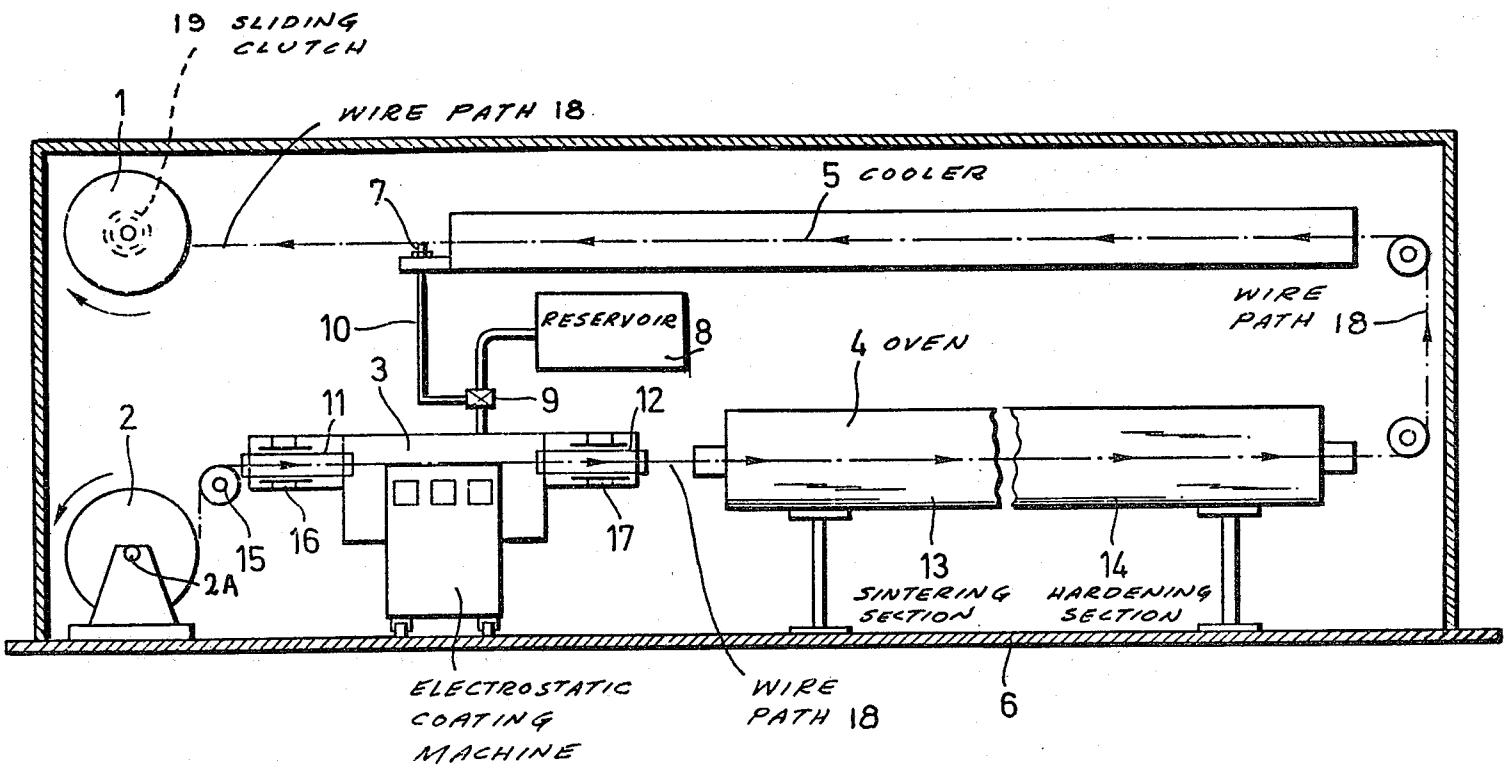
WIRE PATH 18
5 COOLER
4 OVEN
13 SINTERING SECTION
14 HARDENING SECTION
6
WIRE PATH 18
8
RESERVOIR
12
17
9
ELECTROSTATIC COATING MACHINE
WIRE PATH 18
19 SLIDING CLUTCH
7
10
3
11
16
15
2A
1
2

APPARATUS FOR COATING WIRES WITH INSULATOR

This is a division of application Ser. No. 167,323, filed July 10, 1980.

BACKGROUND OF THE INVENTION

1. Field of the Invention

This invention pertains, in its most general sense, to a process for continuously coating elongated and continuous bodies with a suitable protective coating. In its most immediate sense, this invention pertains to a process for coating wire such as that which is used in winding coils, in armatures and the like, and to apparatus with which the process can be carried out.

2. Description of the Prior Art

Wires, particularly wires which are utilized in coils and in windings in rotating machinery, are conventionally insulated so that the coils and windings formed thereby will not short out between adjacent wire sections. Such insulated wires are conventionally referred to as lacquered wires.

In the prior art, lacquered wires are produced by dissolving suitable insulation into a light hydrocarbon binder such as cresol which serves as a solvent, in order to provide a lacquer which is of a suitable viscosity for coating the wire. After the wire has been coated with the lacquer so produced, it is necessary to evaporate the solvent by subjecting the coated wire to elevated temperatures, and it is further necessary to harden the lacquer after the solvent has been evaporated therefrom in order to impart the necessary mechanical characteristics and electrical insulation characteristics which are required for wires of this type.

When this method is utilized, toxic or poisonous gases are emitted during the evaporation and hardening stages of the wire, making the process environmentally polluting. Moreover, the evaporation process is, in and of itself, an energy-intensive one, independently of the energy consumed during the subsequent hardening process.

In Federal Republic of Germany Offenlegungsschrift No. 27 44 721, a pulverized coating is disclosed which can be used to coat many types of articles in order to provide a mechanically stable corrosion shield. This reference also indicates that a pulverized material may be applied to such an article by means of an electrostatic process. Such processes involve the utilization of a coating chamber in which the pulverized material is given a negative charge while the object to be coated is given a positive charge. As a result of the potential difference between the pulverized material and the object to be coated, the pulverized material is set into motion and attracted onto the surface of the article to be coated, forming a coating which may later be sintered and fused onto the article to form a protective coating which is mechanically stable. In such electrostatic coating processes the thickness of the coating is a function of the duration in which the article remains in the coating chamber.

Existing electrostatic coating machines which utilize this principle to coat articles with coatings such as that disclosed in the above-mentioned reference are unsuitable for use in connection with coating elongated and continuous elements such as wire. Even if the structure of such devices were to be modified in order to accommodate wire (a modification not as yet known), such devices would be unsuitable because tolerances in insulation thickness of lacquered wire must as a practical matter be held at least within ±10 micrometers, and preferably better. This type of close-tolerance manufacture is necessary in order to insure that the insulation coating on the wire has a sufficiently high resistance to high voltage so that apparatus in which the wire is installed will not be subject to shorting and will not exceed the dimensions which practice dictates to be necessary.

Finally, it would be desirable to utilize a continuous sintering and hardening process in order to allow a continuous manufacturing process to take place over days and weeks. Such processes depend upon the uniformity of the particle size of the pulverized material which is to be sintered and hardened.

Thus, it would be desirable to provide a method for manufacturing lacquered wire which would not pollute the atmosphere with toxic or poisonous fumes, which would not be as energy-intensive as prior art methods, which would produce lacquered wire with an adequately uniform insulation thickness, and which would utilize a continuous sintering and hardening process.

SUMMARY OF THE INVENTION

These objects, along with other which will appear hereinafter, are achieved in this invention by an apparatus which utilizes a speed-regulated transport system used to pass were to be coated through three stages: a stage of electrostatic coating, a stage of sintering and hardening, and a stage of cooling. The apparatus provides means for continuously monitoring the thickness of the coated wire, means for supplying an insulator in pulverized form, means for sintering and hardening of the coated wire and means for increasing or decreasing supply of insulator in pulverized form in response to the measured value of the insulation thickness so as to maintain a desired insulation thickness within a predetermined tolerance, while the wire is proceeding at a constant even speed chosen and regulated in accordance with the time required for hardening the insulation-coat.

Inasmuch as the insulation utilized is in pulverized form and therefore is not dissolved in any solvent no toxic or poisonous fumes are given off as the solvent evaporates during manufacture. Inasmuch as wire speed through the apparatus can be varied directly in accordance with thickness the apparatus can be used for insulate wire, which is comparatively large and which has a cross-sectional area of more than 1.5 square millimeters. By use of this apparatus insulation thickness can be held to a maximum tolerance of 10 micrometers.

In the process disclosed herein, the powdered insulation is continuously fed into an electrostatic coating machine at such a rate that powdered insulator adhering to the wire in an electrostatic coating process is continuously replenished, avoiding a situation in which the amount of pulverized insulator inside the electrostatic coating machine gradually diminishes. In the event that the supply of pulverized insulator were not held constant within the electrostatic coating machine, a selection process would take place in which the lightest and smallest particles of insulator would first be attracted to the wire to be coated. In this situation, the size of particles attracted to the wire would not be uniform over the entire wire surface, since the lightest particles would be depleted first and as time elapsed, the average size of particles attracted to the wire would increase. This undesirable selection phenomenon would result in a less-uniform product after sintering and hardening.

However, by keeping the quantity of pulverized substance in the electrostatic coating machine constant, and by replenishing this material as it is used, this selection phenomenon is avoided and a uniform insulating coating results.

If desired, both the potential difference between the pulverized insulator and the distance along the wire which is actually exposed thereto can be varied during the process in order to even more accurately control insulation uniformity.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

In the single FIGURE, the method disclosed herein and the apparatus for implementing the method are shown in a single schematic elevational view.

DESCRIPTION OF THE PREFERRED EMBODIMENTS

A storage drum 2 mounted to rotate about an axis 2A so that storage drum 2 can rotate carries uninsulated wire which is made to pass along a wire path 18. The wire path, shown in the FIGURE as a broken line having arrows showing the direction of wire travel, is first made to pass over a speed-regulated roller 15 into the intake end of electrostatic coating machine 3, in which an insulator is electrostatically adhered to the wire as is set forth in more detail below. After having been so coated, the wire passes out of the outlet end of the electrostatic coating machine 3 into the intake end of the sintering and hardening oven 4 into a sintering section 13 where the insulation which has electrostatically adhered to the wire is sintered and subsequently hardened in hardening section 14. After hardening in hardening section 14, the wire passes out the outlet end of oven 4, and is directed into the intake end of a cooler 5 where the insulated wire now bearing a sintered and hardened coating of insulation is cooled down. After cooling, the wire is wound up on a rotatable takeup spool 1 in its finished state, ready for subsequent use.

After the wire passes out of the outlet end of cooler 5 its thickness is measured by a thickness sensor 7. Inasmuch as the original diameter of the wire prior to coating is known, thickness sensor 7 serves the purpose of determining the thickness of the sintered and hardened coating of insulation which is applied to the wire with a high degree of accuracy. Thickness sensor 7, as will be seen hereinafter, is used to regulate the rate of supply of an insulator in pulverized form into the electrostatic coating machine 3 so as to insure a properly uniform insulation thickness all along the wire.

Referring now the operation of electrostatic coating machine 3 in more detail, it can be seen that electrostatic coating machine 3 is attached to reservoir 8 through regulating valve 9. Reservoir 8 contains an insulator in pulverized form which is introduced into electrostatic coating machine 3 in dependence upon setting of valve 9, which setting can be varied in accordance with wire thickness as measured by thickness sensor 7, which thickness sensor 7 is connected to valve 9 via control line 10. Suitable insulators for use in reservoir 8 include thermosetting plastics, such as those which use a polyurethane-polyamide base.

Whenever insulator is introduced into reservoir 8, it is finely pulverized so as to be able to flow smoothly into electrostatic coating machine 3 and to coat the wire in a uniform fashion. Electrostatic coating machine 3 utilizes an AC field to establish a potential difference between the wire and the pulverized insulator. As a result of this potential difference, the pulverized insulator is electrostatically attracted to the wire and adheres thereto.

Still remaining with the operation of electrostatic coating machine 3, it can be seen that the wire path passes through a first shield 11 located within the intake end of electrostatic coating machine 3. As shown in the FIGURE, first shield 11 takes the shape of a hollow cylinder, and is slidable back and forth parallel to wire path 18 within bearing 16. In a similar fashion, second shield 12, also shaped in the form of a hollow cylinder, is located within the outlet end of electrostatic coating machine 3 and can be slid back and forth parallel to wire path 18 within bearing 17. First shield 11 and second shield 12 serve to shield the surface of wire passing through electrostatic coating machine 3. The AC field which is used to attract the insulator introduced into electrostatic coating machine 3 from reservoir 8 only causes insulator to be attracted to an exposed section of the wire. This exposed section exists between the two innermost ends of shields 11 and 12. In the event that the exposed section of the wire is to be increased, which will cause more insulator to be electrostatically attracted to the wire during a given unit of time, shields 11 and 12 can be moved away from each other so as to expose more of the wire surface to the insulator. On the other hand, if the exposed section of the wire is to be reduced in order to reduce the amount of insulator electrostatically adhered thereto per unit time, shields 11 and 12 can be moved towards each other, thereby reducing the exposed surface of the wire to which the insulator is adhered. Finally, the AC field which is used to induce a potential difference between the wire and the insulator can be varied.

It will be appreciated by those skilled in the art that the thickness of the layer which is electrostatically adhered to the wire will depend upon a collection of factors, which factors include the period during which the given section of wire is exposed to the insulator and the magnitude of the potential difference between the insulator and the wire, as well as the quantity of the pulverized insulator within the coating machine. It will be appreciated that the time required for sintering and hardening this insulating layer can be varied by varying wire speed along wire path 18, while the thickness of this insulating layer can be varied by varying distance between shields 11 and 12, or by varying the rate of such supply of pulverized insulator and such distance conjointly also with variation of the potential difference between the wire and the insulator. In one embodiment of the process disclosed herein, the supply of the pulverized insulator alone is varied in direct dependence upon thickness of the wire as measured by thickness sensor 7, whereas in other embodiments of this process any of the factors of wire speed, distance between shields 11 and 12, and potential difference between the wire and the insulator can be simultaneously varied in accordance with wire thickness as measured by thickness sensor 7, the speed of the wire being regulated in accordance with the time required for hardening of the insulating coat such applied on the wire and the mechanical tension thereof, both to be evenly constant at a chosen value for each production.

As mentioned above, control line 10 connects regulating valve 9 to thickness sensor 7. Regulating valve 9 continuously adjusts flow of insulator from reservoir 8 to electrostatic coating machine 3. By so doing, the quantity of insulator inside electrostatic coating machine 3 is held constantly in accordance with the thickness of the insulating coat to be applied. By so doing, the smaller and lighter particles of insulator are not immediately attracted to the wire, leaving larger and heavier particles to be attracted subsequently. As has been set forth above, such a selection phenomenon would deleteriously affect uniformity of insulation thickness, since without such continuous replenishment of the quantity of insulator within the electrostatic coating machine, particle size of insulator attracted to the wire would gradually increase as the smallest and lightest particles were depleted, leaving only heavier and larger ones available for subsequent electrostatic attraction to the wire.

After the wire has been coated with insulator in electrostatic coating machine 3, the wire passes into sintering section 13 of sintering and hardening oven 4. In sintering section 13, the insulator is sintered and adhered to the wire. Sintering section 13 may in fact be a plurality of heating stages which establish an increasing temperature profile. Thus, for example, a subsection of sintering section 13 may initially raise the temperature of the coated wire from room temperature to approximately 200° C. so as to cause the insulation to melt in a uniform fashion over the surface of the wire. Subsequently, another subsection of sintering section 13 may for example raise the temperature of the wire and insulation to approximately 250° C. to conclude the sintering process.

After the sintering process has been concluded, the wire is passed through hardening section 14, which may for example be two subsections placed one after the other in a fashion similar to sintering section 13. For example, hardening may initially take place in a first subsection in which the wire with its sintered coating is heated to perhaps 250° to 300° C. Subsequently, another stage can heat the wire with its sintered and partially hardened coating of insulation to approximately 350° C., to conclude the hardening process.

Sintering and hardening oven 4 may take a plurality of forms. It is possible that sintering and hardening oven 4 may be a multi-stage muffled furnace, and it is possible that the hardening section 14 of sintering and hardening oven 4 may harden the insulation by causing ultraviolet radiation to be directed upon it.

Sintering section 13 and hardening section 14 may have any number of subsections or stages, and may use any type of incident radiation such as infrared radiation and ultraviolet radiation as long as an appropriate temperature profile is established which will properly sinter and harden the particular insulator which is used in reservoir 8 within a period of time, depending upon the length of the respective hardening section 14 and the speed at which the wire is passed therethrough. After sintering and hardening, the wire is passed through an elongated cooler 5, in which the wire can once again be cooled down to room temperature. Cooler 5 may be refrigerated in some way or may merely be an elongated hollow housing in which air passes around the wire and cools it down. In any event, after cooling in cooler 5, wire thickness is measured by a thickness sensor 7. After passing by thickness sensor 7, the wire can be rolled up on takeup spool 1 ready for subsequent use.

Takeup spool 1 cooperates with a sliding clutch, which sliding clutch cooperates with speed-regulated roller 15 in a manner not shown to keep wire tension constant at an appropriate value. Moreover, thickness sensor 7 cooperates with roller 15 via appropriate devices (not shown) to vary wire speed in accordance with wire thickness as measured at the outlet end of cooler 5. In one embodiment of the process disclosed herein, distance between shields 11 and 12 is preset, as is the potential difference between the wire and the insulator, and only insulation-powder supply is varied, in direct dependence upon wire thickness as measured at thickness sensor 7. In another embodiment of the process disclosed herein, any of the factors of wire speed, distance between shields 11 and 12, and potential difference may be varied in order to achieve an appropriately uniform insulation thickness.

In an alternative embodiment, thickness sensor 7 is not disposed at the outlet end of cooler 5 but is rather disposed between the outlet end of sintering and hardening oven 4 and the intake end of cooler 5. It is only necessary to measure thickness of the coated wire after the sintering and hardening processes have been completed.

The apparatus disclosed herein can be arranged in a compact fashion. As shown in the FIGURE, the drum 2, electrostatic coating machine 3, and sintering and hardening oven 4 are all attached to a base plate 6, which supports these elements on appropriate stands.

The process disclosed herein can produce satisfactory lacquered wires even with large cross-sectional areas. By way of a first example, a wire with a cross-sectional area of 10 square millimeters can be coated with insulation to a thickness of 120 micrometers within a tolerance of ±10 micrometers. In order to accomplish this result, the sintering and hardening oven 4 is 4 meters long, wire speed is 5 meters per minute, the exposed section of wire inside the electrostatic coating machine 3 is 400 millimeters, and the potential difference between the wire and the insulator is set at 20 kilovolts. By way of a second example, a wire with a cross-sectional area of 50 square millimeters can be likewise coated with insulation to a thickness of 120 micrometers, when the sintering and hardening oven 4 is 6 meters long, when the wire speed is set at 2 meters per minute, when the exposed section of the wire is 500 millimeters long, and when the potential difference is increased to 25 kilovolts.

It can now be seen that because no solvent is used in connection with the insulation in reservior 8, no toxic or poisonous fumes are emitted during the process disclosed herein, resulting in a non-polluting insulation process. Moreover, the process is entirely continuous since it is possible to accurately coat wire of even large cross-sectional area with a desired thickness of insulation within a predetermined tolerance by varying the quantity of the insulator supplied in pulverized form into the coating machine, the exposed wire section therein and/or potential difference conjointly with each other. In this connection, it is noteworthy that in order to achieve these results, the insulation within the electrostatic coating machine 3 must remain uninfluenced by any disturbing factors, such as gas flows and the like.

It will be understood that each of the elements described above, or two or more together, may also find a useful application in other types of methods and arrangements differing from the types described above.

While the invention has been illustrated and described as embodied in a method and arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for continuously coating wire and the like elongated bodies with insulation or like coatings, comprising a reservoir for containing a pulverized insulator; an electrostatic coating machine having an inlet end and an outlet end for the wire and connection means to the reservoir to receive pulverized insulator therefrom, and operative for coating wire continuously passing therethrough with the insulator received from said reservoir by establishing a potential difference between the wire and the insulator, said machine being capable of applying a thickness of coating to the wire proportional to the rate of supply of insulator received by the machine from said reservoir, a sintering and hardening oven continuously receiving the coated wire from said electrostatic coating machine and continuously sintering and hardening the coating thereon; a cooler for continuously receiving the coated wire from said oven and cooling the coated wire; means for passing the wire with even speed through said electrostatic coating machine, said oven and said cooler; a thickness sensor downstream of said oven for continuously monitoring coating thickness after the coating has been sintered and hardened; and control means interconnected between said thickness sensor and said electrostatic coating machine for adjusting the rate of supply of the pulverized insulator into the electrostatic coating machine in dependence upon coating thickness, whereby coating thickness is maintained at a desired value within a predetermined tolerance.

2. The device of claim 1, further comprising means for adjusting the operation of the electrostatic coating machine, including a first shield located within said inlet end of said electrostatic coating machine for shielding the wire passing therethrough and a second shield located within said outlet end of the electrostatic coating machine for shielding the wire passing therethrough, said first and second shields being adapted to move along the wire towards and from each other, whereby a section of the wire exposed to the pulverized insulator received from said reservoir can be lengthened and shortened.

3. The device of claim 2, wherein said control means include a control valve located in said connection means intermediate said reservior and said electrostatic coating machine for regulating the flow of insulator from said reservoir to said coating machine.

4. The device of claim 3, wherein said sintering and hardening oven includes an elongated sintering section operated for sintering the insulator on wire passing therethrough by application of controllable heat action to the wire being processed, and an elongated hardening section communicating with said sintering section and operative for hardening the insulator on wire passing therethrough by application of controllable heat action to the wire being processed.

5. The device of claim 4, wherein said oven is a multistage muffled furnace.

6. The device of claim 4, wherein heat in said hardening section is provided by means for applying ultraviolet rays to the wire being processed.

7. The device of claim 2, further including means to vary the potential difference between the wire and the insulator in said electrostatic coating machine.

8. The device of claim 4, further including a wire storage drum connected to the electrostatic coating machine and a take up spool connected to said cooler for receiving the coated wire therefrom, and a sliding clutch connected to the take up spool.

9. The device of claim 1, wherein said thickness sensor is located between the sintering and hardening oven and the cooler.

10. The device of claim 1, wherein said thickness sensor is located after the cooler to measure coating thickness after the coated wire has been cooled.

* * * * *